US008032242B2

(12) United States Patent
Aiso et al.

(10) Patent No.: US 8,032,242 B2
(45) Date of Patent: Oct. 4, 2011

(54) MIXING SYSTEM AND FORMAT CONVERSION DEVICE AND METHOD THEREFOR

(75) Inventors: Masaru Aiso, Hamamatsu (JP); Masaaki Okabayashi, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 1008 days.

(21) Appl. No.: 11/864,373

(22) Filed: Sep. 28, 2007

(65) Prior Publication Data

US 2008/0080724 A1 Apr. 3, 2008

(30) Foreign Application Priority Data

Sep. 29, 2006 (JP) ..... 2006-268441

(51) Int. Cl.
*G06F 17/00* (2006.01)
*H04B 1/00* (2006.01)

(52) U.S. Cl. ..... 700/94; 381/119

(58) Field of Classification Search ..... 700/94; 381/119; 369/1–12
See application file for complete search history.

(56) References Cited

U.S. PATENT DOCUMENTS 7,089,333 B2 8/2006 Marinescu et al.
2004/0233852 A1* 11/2004 Ochi et al. ..... 370/242
2005/0027888 A1* 2/2005 Juszkiewicz ..... 709/250
2006/0248173 A1* 11/2006 Shimizu ..... 709/220

FOREIGN PATENT DOCUMENTS

JP 2005-503060 1/2005
WO WO-03023759 3/2003

OTHER PUBLICATIONS

"PC5D Digital Mixing Console, PM5D/PM5D-RH Owner's Manual", Yamaha Corporation, pp. 16-18 with cover sheet and last page of manual.
"AD8HR, AD Converter With Remote Preamp Owner's Manual", Yamaha Corporation, p. 10 with cover sheet and last page of manual.

* cited by examiner

*Primary Examiner* — Andrew C Flanders
(74) *Attorney, Agent, or Firm* — Morrison & Foerster LLP

(57) ABSTRACT

One format converter connected to a mixer and another format converter connected to a head amplifier are interconnected via a single control/audio communication line. Each of the format converters includes a communication interface, control signal interface, audio signal interface, and a control section. The control section converts control data and audio data into data compliant with the EtherSound (registered trademark) that allows the control data and audio data to be transmitted over a single physical cable, and then it transmits, over the physical cable, the converted data from the communication interface to the other format converter.

14 Claims, 7 Drawing Sheets

MIXING SYSTEM AND FORMAT CONVERSION DEVICE AND METHOD THEREFOR

BACKGROUND OF THE INVENTION

The present invention relates to a mixing system for allowing an audio mixer to remote-control external or peripheral devices that are involved in audio signal processing.

Among the conventionally-known digital audio mixers are ones to which can be connected an external device or peripheral device corresponding to remote operation based on a dedicated communication protocol. For example, a digital audio mixer marketed by the assignee of the instant application under the trade name "PM5D" and a head amplifier marketed by the assignee of the instant application under the trade name "AD8HR" are provided with respective dedicated remote terminals (such as serial communication interfaces of the RS422 standard), and the head amplifier can be controlled by the mixer by connecting the mixer and head amplifier using a physical cable (functioning as a control line) compliant with the communication standard of the remote terminals. Further, the head amplifier is connected to the mixer via a physical cable (functioning as an audio line) compliant with a predetermined digital audio signal transmission standard, such as the AES/EBU standard, and audio signals of a plurality of channels input from an input device, such as a microphone, into the head amplifier are output to the digital audio mixer over the audio lines. Namely, two different types of cables, i.e. one physical cable functioning as an audio line for transmitting audio signals and another physical cable functioning as a control line for transmitting control signals for the remote control, are installed to extend between the head amplifier and the mixer.

A plurality of head amplifiers can be connected, in a "daisy-chain connection" configuration, to the conventionally-known digital mixer. The head amplifiers each include two remote terminals, so that these head amplifiers can be interconnected, e.g. by connecting one remote terminal of the first head amplifier to the remote terminal of the mixer, connecting one remote terminal of the second head amplifier to the other remote terminal of the first head amplifier, connecting one remote terminal of the third head amplifier to the other remote terminal of the second head amplifier, and so on. The individual head amplifiers connected to the mixer are automatically assigned serial ID numbers with the leading ID number being assigned to the first head amplifier connected directly to the remote terminal of the mixer (see, for example, http://www2.yamaha.co.jp/manual/pdf/pa/japan/mixers/PM5DJI.pdf, and http://www2.yamaha.co.jp/manual/pdf/pa/japan/others/ad8 hr_ja_om.pdf).

FIG. 7 is a block diagram showing an example construction or setup of a conventional mixing system where a plurality of head amplifiers are "daisy-chain" connected to a mixer. Here, one mixer 1 and the plurality of (12 (twelve) in the illustrated example of FIG. 7) head amplifiers 2 are connected, in a daisy-chain configuration, via a control-signal transmitting control line 3. The individual head amplifiers 2 are automatically assigned serial ID numbers "#1", "#2", "#3", . . . , "#12" with the leading ID number being assigned to the head amplifier connected directly to the remote terminal of the mixer 1. Once the mixer 1 transmits, over the control-signal transmitting control line 3, control signals containing the ID number of a particular one of the head amplifiers 2, which is to be remote-controlled, the control signals are transferred between the head amplifiers 2 in the order the head amplifiers 2 are daisy-connected. Then, only the particular head amplifier 2 receives the control signals, so that settings of various parameters of the particular head amplifier 2 can be remote-controlled per channel by the mixer 1. As illustrated in FIG. 7, digital audio signals are transmitted from the individual head amplifiers 2 to the mixer 1 over audio lines 4, and one such audio line 4 for transmitting audio signals is installed per head amplifier 2; thus, 12 (twelve) audio lines 4 extending from the 12 head amplifiers 2 are connected to the mixer 1. Note that, in FIG. 7, the control line 3 is indicated by a thick line while the audio lines 4 are indicated by thin lines.

Generally, in a large-size concert venue, for example, the mixer 1 is installed within a control booth located in a central area, rear end area or the like of the concert venue, while the head amplifiers 2 are installed near input equipment on the stage (e.g., on a side of the stage). The reason why the head amplifiers 2 are installed near the input equipment is that it is desirable that analog audio lines connecting the head amplifiers 2 and the input equipment be as short as possible with a view to preventing unwanted mixing-in of noise, degradation of tone quality, etc.

However, because the installed positions of the mixer 1 and the head amplifiers 2 are physically distant from each other, the control line 3 and audio lines 4 extending between the mixer 1 and the head amplifiers 2 would have very great lengths. In addition, because one audio line 4 extends from each of the head amplifiers 2, the total number of the audio lines 4 would increase as the number of the head amplifiers 2 to be installed increases; thus, a multiplicity of the audio lines 4 have to be provided depending on the number of the head amplifiers 2 to be installed. Thus, with the conventional mixing system, operation for installing wiring between the mixer 1 and the head amplifiers 2 tends to be very cumbersome and require high wiring cost.

SUMMARY OF THE INVENTION

In view of the foregoing, it is an object of the present invention to provide an improved mixing system in which at least one external device or peripheral device involved in audio signal processing is connected to a mixer, which is of a relatively large size with the mixer and the at least one external device or peripheral device positioned at a great distance from each other, and which can greatly simplify necessary wiring and reduce necessary wiring cost by using constructions of a conventional mixer and peripheral device (i.e., conventional mixer and peripheral device constructions) without modifying the conventional mixer and peripheral device constructions. It is another object of the present invention to provide an improved format conversion device for implementing such an improved mixing system. It is still another object of the present invention to provide a format conversion method for use a mixing system.

According to an aspect of the present invention, there is provided an format conversion device for use in a mixing system that includes an audio mixer and at least one peripheral device involved in audio signal processing, a first-type cable functioning as a control data communication line for communicating control data using a predetermined control data communication format and a second-type cable functioning as an audio data communication line being connectable to each of the mixer and the peripheral device, the format conversion device comprising: a first-type interface for connection with the first-type cable; a second-type interface for connection with the second-type cable; a third-type interface for connection with a third-type cable functioning as a control/audio line, the control/audio line functioning to communicate data using a control/audio communication format that allows control data and audio data to be transmitted over a common cable; and a control section connected to each of the first-type, second-type and third-type interfaces, the control section acting as a bridge for data delivery between the first- and second-type interfaces and the third-type interface and also converting a communication format of data, to be delivered from a transmitting-side interface to a receiving-side interface, from a communication format of the transmitting-side interface to a communication format of the receiving-side interface.

According to another aspect of the present invention, there is provided an improved mixing system including at least first and second format conversion devices each constructed in the aforementioned manner. The first format conversion device of the present invention has the first- and second-type interfaces thereof connected to the mixer via the first- and second-type cables, respectively, the second format conversion device has the first- and second-type interfaces thereof connected to at least one peripheral device via the first- and second-type cables, respectively, and the third-type interface of the first format conversion device and the third-type interface of the second format conversion device are connected with each other. Further, in the mixing system of the present invention, a plurality of the external or peripheral devices may be daisy-chain connected to the format conversion device. Furthermore, in the mixing system, a plurality of other format conversion devices may be connected to one format conversion device connected to the audio mixer via the control/audio communication line.

Namely, according to the present invention, as set forth above, there is provided, between the mixer and the peripheral device, the format converter constructed to convert control data and audio data into data of the control/audio communication format that allows the control data and audio data to be transmitted over the single, common physical cable. Thus, in the present invention, only the single, common physical cable needs to be installed between the audio mixer and the peripheral device that used to be interconnected via two types of physical cables, i.e. those of a control data communication line and audio data communication line. Further, a relatively-inexpensive general-purpose LAN cable can be used as the single, common physical cable. As a result, the present invention can advantageously simplify the necessary wiring between the mixer and the peripheral device. Furthermore, because the number of cables used can be reduced as noted above, the present invention can also advantageously reduce the wiring cost. Particularly, in a large-scale mixing system where the mixer and the peripheral device are positioned at a great distance from each other, the present invention can achieve greatly-simplified wiring and greatly-reduced wiring cost. Furthermore, because the conventionally-known method can be used as-is for transmission of control data from the audio mixer to the peripheral device, it can be suitably applied to the present invention without any particular modification being made to the constructions and specifications of the conventionally-known audio mixer and peripheral device being modified at all.

According to still another aspect of the present invention, there is provided an improved format conversion method for use in a mixing system that includes an audio mixer and at least one peripheral device involved in audio signal processing, a first-type cable functioning as a control data communication line for communicating control data using a predetermined control data communication format and a second-type cable functioning as an audio data communication line being connectable to each of the mixer and the peripheral device, said format conversion method comprising: a step of providing a first-type interface for connection with the first-type cable which is connected to one of the audio mixer and the at least one peripheral device; a step of providing a second-type interface for connection with the second-type cable which is connected to one of the audio mixer and the at least one peripheral device; a step of providing a third-type interface for connection with a third-type cable functioning as a control/audio line, said control/audio line functioning to communicate data using a control/audio communication format that allows control data and audio data to be transmitted over a common cable; and a step of providing a control section connected to each of said first-type, second-type and third-type interfaces, said control section acting as a bridge for data delivery between said first- and second-type interfaces and said third-type interface and also converting a communication format of data, to be delivered from a transmitting-side interface to a receiving-side interface, from a communication format of the transmitting-side interface to a communication format of the receiving-side interface.

The following will describe embodiments of the present invention, but it should be appreciated that the present invention is not limited to the described embodiments and various modifications of the invention are also possible without departing from the basic principles. The scope of the present invention is therefore to be determined solely by the appended claims.

BRIEF DESCRIPTION OF THE DRAWINGS

For better understanding of the objects and other features of the present invention, its preferred embodiments will be described hereinbelow in greater detail with reference to the accompanying drawings, in which.

DETAILED DESCRIPTION OF THE INVENTION

Figure 1:
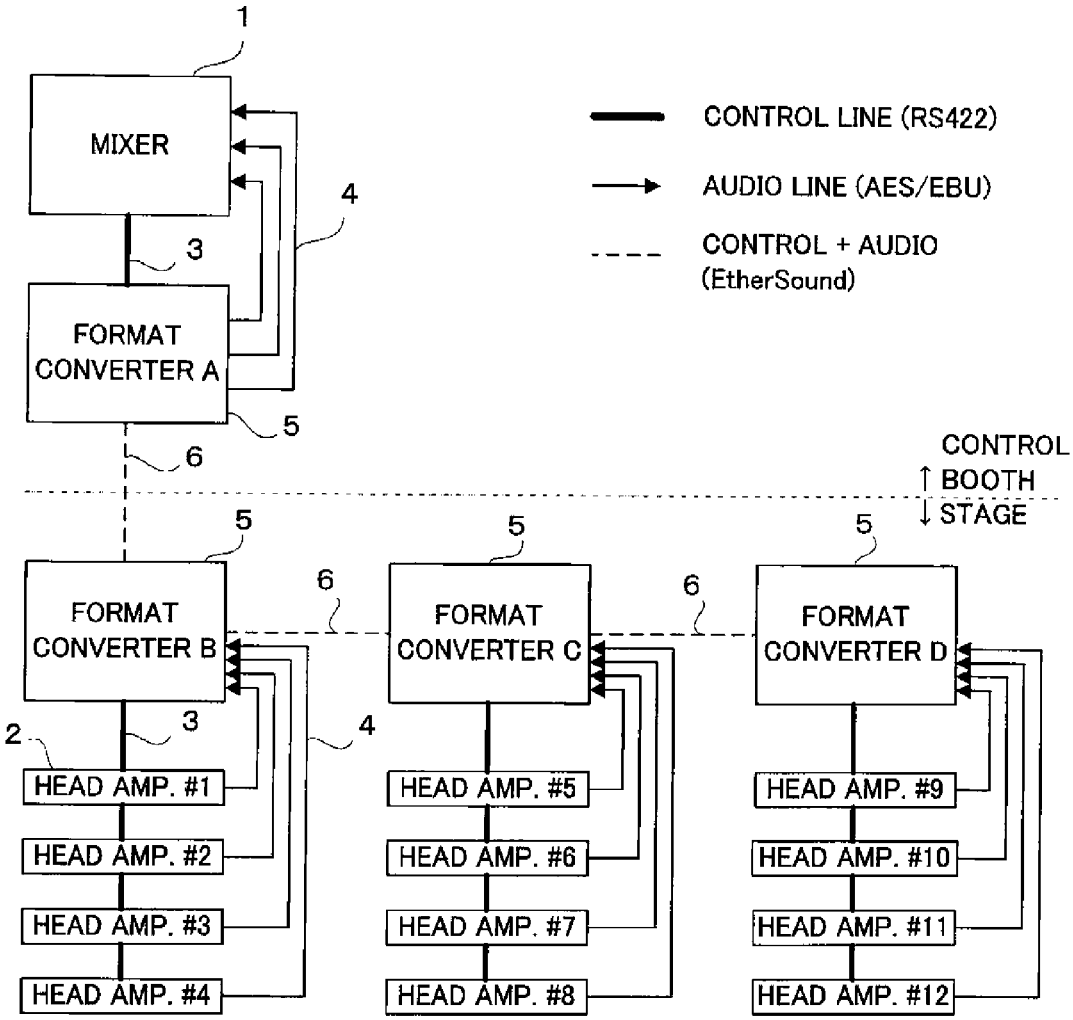
FIG. 1 is a block diagram showing an example general setup of a mixing system in accordance with an embodiment of the present invention.

FIG. 1 shows an example general setup of a mixing system in accordance with an embodiment of the present invention. In this embodiment of the mixing system, audio signals of a plurality of channels input to a plurality of head amplifiers 2 are transmitted to a mixer 1, and each of the head amplifiers 2 can be remote-controlled by the mixer 1. The head amplifiers 2 are devices peripheral to the mixer 1.

The mixer 1 and head amplifiers 2 may each be of the conventional construction. In the instant embodiment, it is assumed, for example, that the mixer 1 is the digital audio mixer marketed by the assignee of the instant application under the trade name "PM5D" while the head amplifiers 2 are each the head amplifier marketed by the assignee of the instant application under the trade name "AD8HR". Further, the mixer 1 and head amplifiers 2 are provided with respective remote terminals (such as serial communication interfaces of the RS422 standard), and control signals can be transmitted to the outside over control lines 3. Furthermore, the mixer 1 and head amplifiers 2 are provided with respective digital audio terminals compliant with a predetermined digital audio signal transmission standard, such as the AES/EBU standard, so that digital audio signals of a plurality of channels can be transmitted to the outside over audio lines 4 connected to the digital audio signals. In FIG. 1, each control line 3 is indicated by a thick line, while each audio line 4 is indicated by a thin line. Namely, the mixer 1 and each of the head amplifiers 2 are interconnected via a first-type cable functioning as the control line 3 and a second-type cable functioning the audio line 4.

In the mixing system according to the embodiment of the present invention, a plurality of (four in the illustrated example) format converters 5 are provided between the mixer 1 and the head amplifiers 2; in FIG. 1, alphabetical letters "A", "B", "C" and "D" are suffixed to the format converters 5 to clearly distinguish among the converters 5. Each of the format converters 5 has a function of converting control signals, received over the control line 3, and digital audio signals, received over the audio lines 4, into a communication format (i.e., control/audio communication format) which allows the control and digital audio signals to be transmitted over a single common physical cable 6 (indicated by a dotted line), or a function of converting data, received over the physical cable 6, into a communication format (i.e., audio data communication format) via which that the data can be transmitted over the audio lines 4 or into a communication format (i.e., control data communication format) which allows the data to be transmitted over the control line 3.

Figure 2:
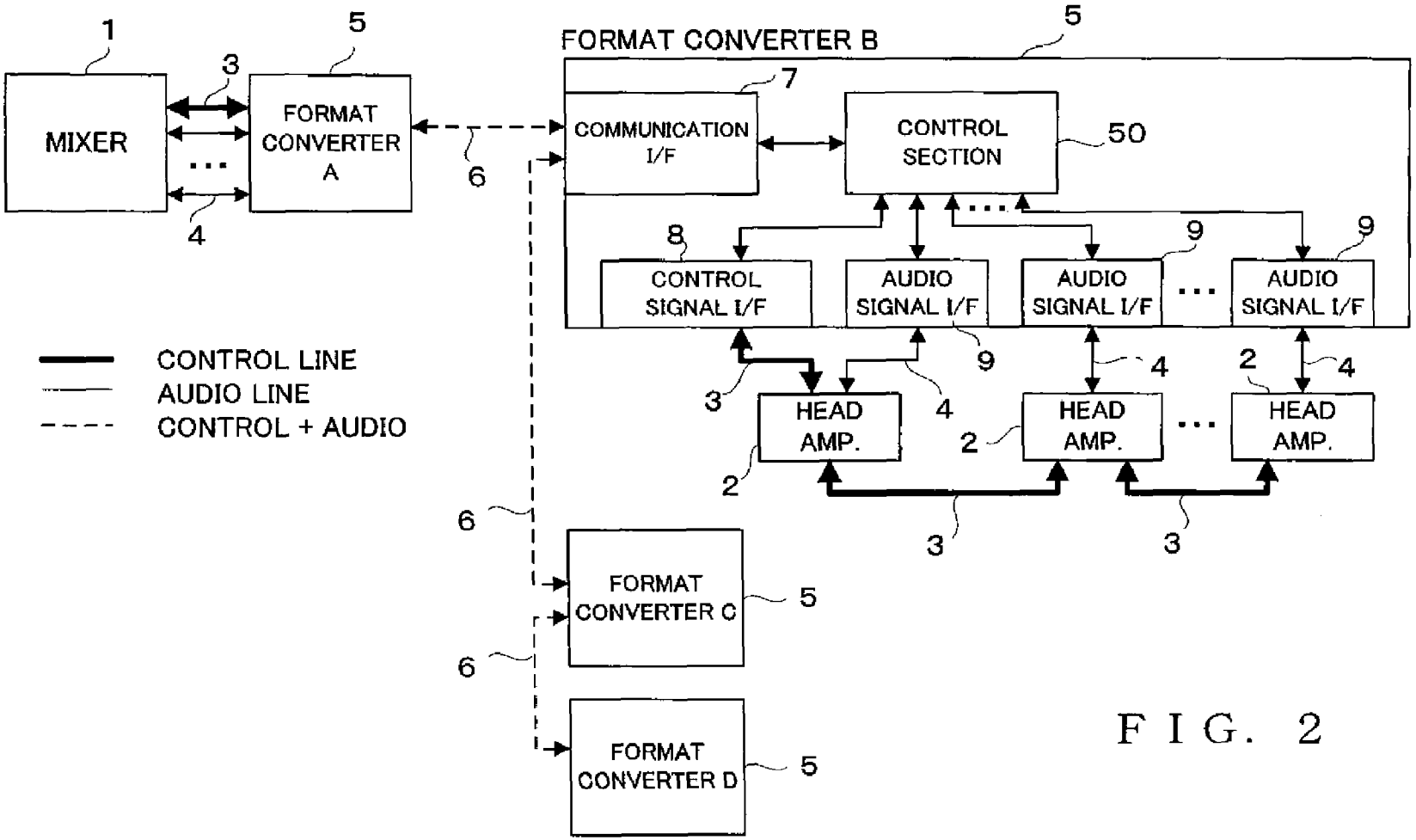
FIG. 2 is a block diagram showing an example functional setup of a representative one of format converters employed in the embodiment.
Figure 3:
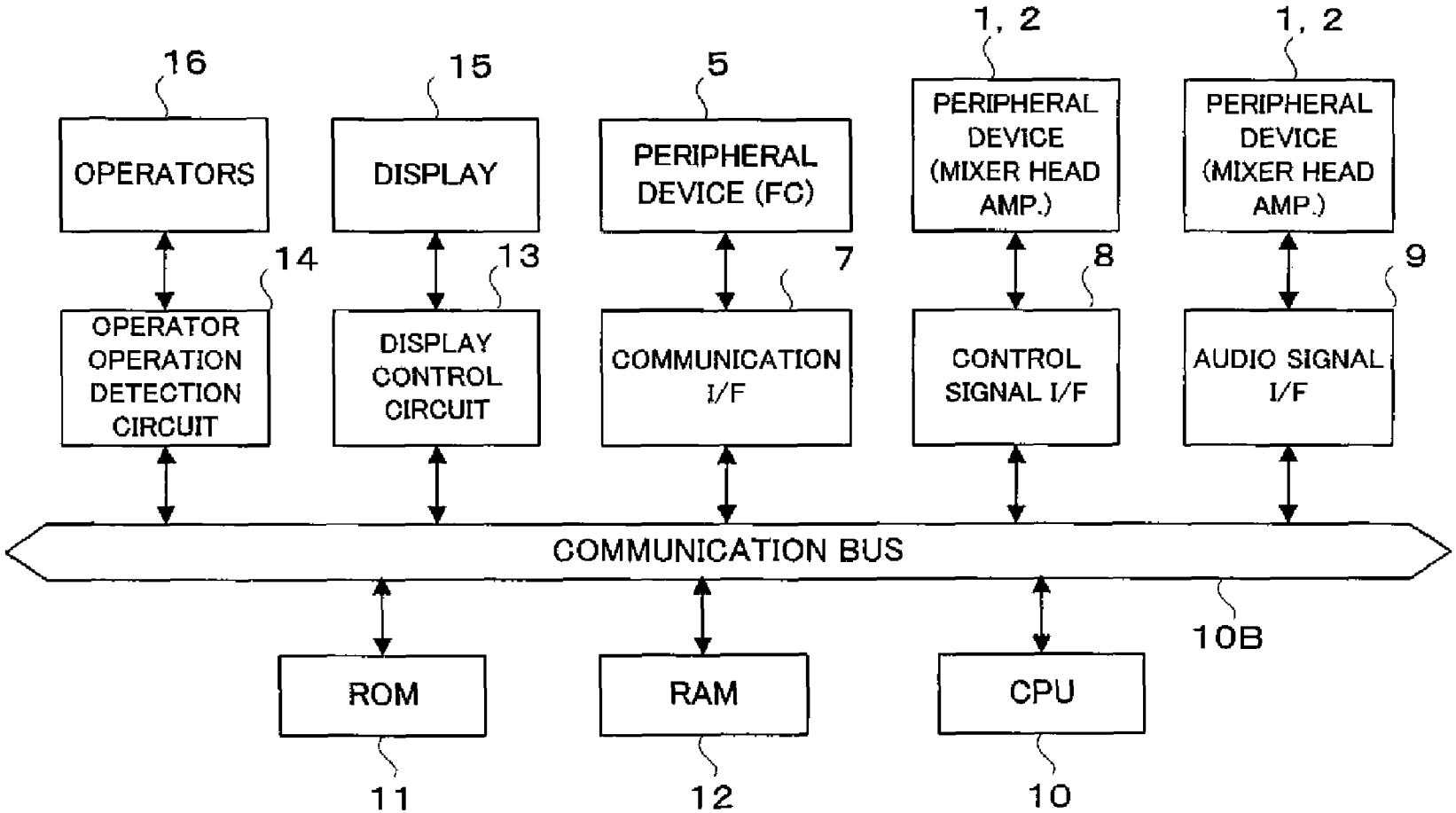
FIG. 3 is a block diagram showing an example electric hardware setup of the format converter in the embodiment

FIG. 2 is a block diagram explanatory of an example functional setup of a representative one of the format converters 5 ("format converter B" in the illustrated example of FIG. 2); namely, the format converters 5 are identical to one another in fundamental construction, and the representative format converter 5 ("format converter B") will be described primarily. FIG. 3 is a block diagram outlining an example electric hardware setup of the format converter 5. As shown in FIG. 3, the format converter 5 includes: a microcomputer comprising a CPU 10, a ROM 11 and a RAM 12; a communication interface (I/F) 7; a control signal interface 8; audio signal interfaces (I/Fs) 9; a display control circuit 13; and an operator operation detection circuit 14, and these components are connected with one another via a communication bus IB.

The above-mentioned microcomputer, comprising the CPU 10, ROM 11 and RAM 12, corresponds to a control section 50 shown in FIG. 2, which performs communication control of the format converter 5 and controls various operations of the format converter 5, such as format conversion processing on audio and control signals input/output via the control signal interface 8 and audio signal interface 9.

The communication I/F 7 is a control/audio communication interface that corresponds to the control/audio communication format via which the control and digital audio signals can be transmitted over the single, common physical cable 6; in the instant embodiment, the communication I/F 7 is, for example, in the form of a network interface of the EtherSound® standard. General-purpose LAN cable, such as a CAT5 cable, may be used as the cable 6 connected to the communication I/F 7. In this specification, the LAN cables 6 interconnecting the format converters 5 will hereinafter be referred to also as "control/audio lines" or "third-type cables". With the above-mentioned EtherSound protocol, Ethernet frames, each comprising a packet containing audio signals of 64 channels and a packet containing control signals, can be communicated bi-directionally on a frame-by-frame basis. Thus, between the format converters 5, digital audio signals and control signals can be communicated over the control/audio line, comprising one physical cable, using the EtherSound protocol.

As seen in FIG. 2, the format converter 5 ("format converter B") is connected with another format converter ("external device FC" in FIG. 1) 5 via the general-purpose LAN cable 6 connected to the communication I/F 7. Further, the communication I/F 7, which is capable of a daisy-chain or star connection, can interconnect a plurality of the format converters 5. Thus, the communication I/F 7 is provided with at least two terminals for connection with the control/audio lines 6.

The control signal I/F 8 is a serial communication interface (control data communication interface) compliant with, for example, the RS 422 standard, and the control signal I/F 8 is used for transmission, via the control line 3, of control signals between the format converter 5 and an external device (mixer 1 or head amplifier 2). Here, the communication standard with which the control signal I/F 8 is compliant corresponds to a communication protocol (control data communication format) which allows the mixer 1 to transmit control signals to the head amplifier 2 to remote-control the head amplifier 2. Such a control-signal transmitting communication protocol will hereinafter be referred to as "command communication protocol".

Further, each of the audio signal I/Fs 9 is an interface (audio data communication interface) compliant with a predetermined digital audio signal transmission standard, such as the AES/EBU standard, and the audio signal I/F 9 is used for transmission, via the control line 3, of control signals between the format converter 5 and an external device (mixer 1 or head amplifier 2). Here, the digital audio signal transmission standard of the audio signal I/F 9 corresponds to a digital-audio-signal transmission standard (audio data communication format) which is used for transmission of digital audio signals between the mixer 1 and the head amplifier 2. Such a digital-audio-signal transmission communication protocol will hereinafter be referred to as "audio communication protocol". Note that each of the format converters 5 is provided with a plurality of the audio signal I/Fs 9 so that a plurality of the audio lines 4 can be connected to the format converter 5.

The format converter 5 may be provided with user interfaces, such as the display 15 and operators 16. Various information is displayed on the display 15 on the basis of instructions given from the CPU 10 to the display control circuit 13. Further, each of various operation input into the format converter 5 is detected by the operator detection circuit 14, and the CPU 10 performs predetermined control in accordance with the detected operation input.

The control section 50 is coupled with each of the interfaces 7, 8 and 9 and acts as a bridge for data delivery between the first- and second-type interfaces 8, 9 and the third-type interface 7. Further, the control section 50 converts a communication format of data, to be delivered from a delivering (i.e., delivered-from) interface to a receiving (i.e., delivered-to) interface, to a communication format of the receiving interface.

More specifically, when data are to be delivered from the first-type interface 8 to the third-type interface 7, the control section 50 converts control data of the control data communication format into the control/audio communication format. When data are to be delivered from the second-type interface 9 to the third-type interface 7, the control section 50 converts control data of the audio data communication format into the control/audio communication format. Further, when data are to be delivered from the third-type interface 7 to the first-type interface 8, the control section 50 converts control data of the control/audio communication format into the control data communication format. Further, when data are to be delivered from the third-type interface 7 to the second-type interface 9, the control section 50 converts audio data of the control/audio communication format into the audio data communication format.

The format conversion processing performed by the control section 50 will be outlined below. Namely, the control section 50 converts data corresponding to a control signal, included in packet data (control signal and/or audio signals) received via the communication I/F 7, into the communication format corresponding to the command communication protocol and transmits the format-converted data to an external device (mixer 1 or head amplifier 2) via the control signal I/F 8. Also, the control section 50 converts data corresponding to audio signals, included in the packet data received via the communication I/F 7, into the communication format corresponding to the audio communication protocol and transmits the format-converted data to an external device (mixer 1 or head amplifier 2) via the audio signal I/Fs 9. Furthermore, the control section 50 converts a control signal received via the control signal I/F 8 and audio signals received via the audio signal I/Fs 9, into the format corresponding to the communication protocol (e.g., EtherSound protocol) used in the control/audio lines 6 and transmits the format-converted data to an external device (other format converter 5) via the communication I/F 7.

Next, with reference to FIGS. 1 and 2, a description will be given about forms of connection of the individual devices in the instant embodiment of the mixing system. As shown in FIGS. 1 and 2, "format converter A" is connected directly to the mixer 1, and two types of physical cables, i.e. control line 3 for transmitting control signals and audio lines 4 for transmitting digital audio signals, are installed to extend between the mixer 1 and "format converter A". Thus, as viewed from the mixer 1, the connection with the external device (format converter 5) is of the same form of connection as in the conventional counterpart.

The other three format converters 5, i.e. "format converter B", "format converter C" and "format converter D", are daisy-chain connected to "format converter A" connected directly to the mixer 1. The format converters 5 are interconnected via the control/audio lines 6, and a communication network compliant with the EtherSound protocol is constructed of these format converters 5. The format converters 5 are each assigned a unique IP address on the communication network, and with the thus-assigned IP addresses, each of the format converters 5 can recognize that other format converters 5 are also resident on the communication network.

A plurality of (four in the illustrated example of FIG. 1) head amplifiers 2 are daisy-chain connected, via the control line 3, to each of "format converter B", "format converter C" and "format converter D". The first head amplifier 2 connected directly to the format converter 5 is connected to the control signal IF 8 of the format converter 5. The first head amplifier 2 and other head amplifiers 2 following the head amplifier 2 are interconnected via the control line 3. Further, from each of the plurality of head amplifiers 2*a* daisy-chain connected to the format converter 5, one audio line 4 is installed to connect to the daisy-chain-source format converter 5 ("format converter B", "format converter C' or format converter D"). Thus, as viewed from each of the head amplifiers 2, two types of physical cables, i.e. control line 3 for transmitting control signals and audio lines 4 for transmitting digital audio signals, are installed to extend between the head amplifier 2 and the format converter 5.

Audio signals flow as follows in the mixing system of FIG. 1. Each of the head amplifiers 2 receives analog audio signals of a plurality of channels from an input device, such as a microphone, converts the received analog audio signals of the plurality of channels into digital audio signals and transmits the converted digital audio signals over the audio line 4. Each of "format converter B", "format converter C" and "format converter D" receives, over the audio lines 4, digital audio signals from each of the corresponding head amplifiers 2, and it converts the received audio signals into the format corresponding to the communication protocol (e.g., EtherSound protocol) designed for data transmission over the control/audio line 6. Then, the format converter transmits the audio signals (packet data), converted into the EtherSound protocol, to "format converter A" over the control/audio line 6. Then, "format converter A" converts the audio signals (packet data), received over the control/audio line 6, into audio signals of the format corresponding to the audio communication protocol and then transmits the converted audio signals to the mixer 1 over the audio line 4. Whereas FIG. 1 shows, by way of example, three audio lines 4 installed to extend between format converter A" and the mixer 1, the total number of the audio lines 4 depends on the total number of audio channels to be transmitted at a time from "format converter A" to the mixer 1 and specification (maximum number of channels) of the audio line 4; whereas just three cables are indicated in FIG. 1 as an example plurality of audio lines 4 installable between "format converter A" and the mixer 1, it should be noted that the number of cables is not based on the number of other converters 5 (three converters 5 in the illustrated example) connected to "format converter A".

In a case where the mixing system of FIG. 1 is applied to a large-size concert venue, for example, "format converter A" connected to the mixer 1 is positioned near the mixer 1 (in the neighborhood of a control booth) while "format converter B", "format converter C" or "format converter D", having the head amplifiers 2 connected thereto, is positioned near the head amplifiers 2 (on or in the neighborhood of a stage). Thus, wiring extending a considerably long distance between "format converter A" and "format converter B" may comprise only one control/audio line 6. Further, wiring of the audio and control lines 4 and 3, which would require complicated and many wires, needs to be installed to extend a short distance only between each of the format converters 5 and the mixer 1 or head amplifier 2. As noted above, the control/audio line 6 may be in the form of a relatively inexpensive general-purpose LAN cable. Thus, the instant embodiment can simplify necessary wiring in a large-size mixing system and significantly reduce wiring cost.

In the instant embodiment of the mixing system, it is desirable that the remote control of each of the head amplifiers 2 by the mixer 1 (i.e., communication of control signals between the mixer 1 and each of the head amplifiers 2) be performed in the conventionally-known manner. Because, requiring modification and addition of new elements to the constructions and specifications of the conventional mixer and head amplifier (i.e., conventional mixer and head amplifier constructions and specifications) in order to introduce the format converters 5 is not desirable from the viewpoints of time and labor, cost, etc. As a result, another advantageous benefit is achievable by the feature of permitting remote control of the head amplifiers 2 by the mixer in the conventional manner (i.e., using the conventional remote control scheme or method) in the inventive mixing system provided with the format converters 5. Therefore, the following paragraphs describe the assignment, to the individual head amplifiers 2, of the unique ID numbers and remote control of the head amplifiers 2 which are performed in the instant embodiment in order to allow the head amplifiers 2 to be remote-controlled by the mixer 1 using the conventional remote control scheme or method.

Figure 7:
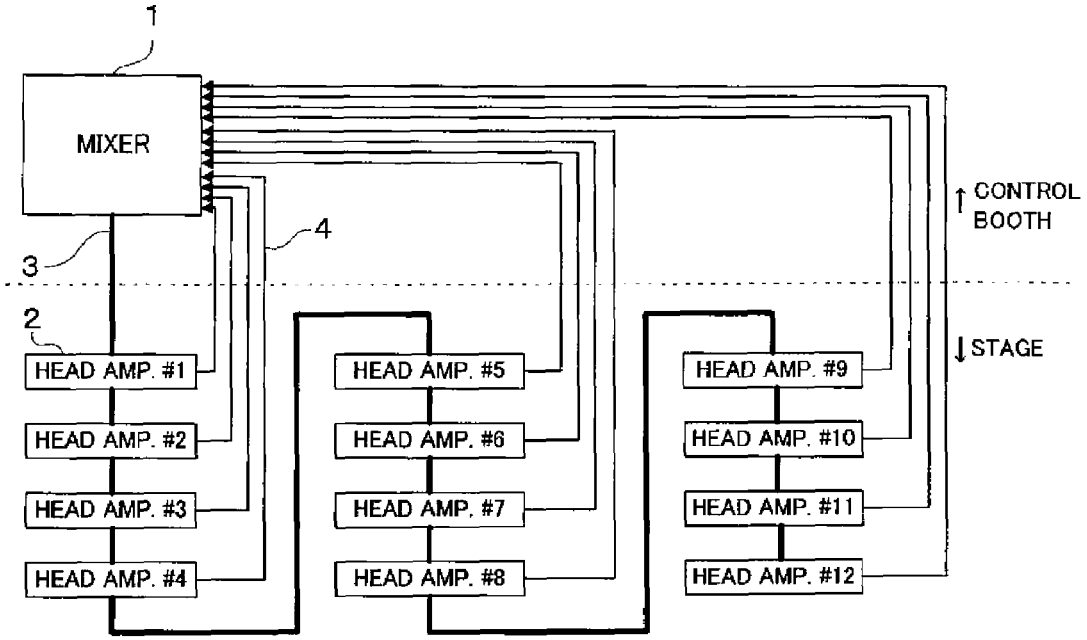
( PRIOR ART ) F I G. 7
FIG. 7 is a block diagram showing an example setup of a conventionally-known mixing system.

The head amplifiers 2 connected to the instant embodiment of the mixing system are assigned respective unique ID numbers. The unique ID numbers of the head amplifiers 2 are usable by the mixer 1 to designate a particular one of the head amplifiers 2 to be remote controlled. Thus, it is assumed here that the unique ID numbers are assigned to the head amplifiers 2, on the basis of generally the same concept as explained above in relation to the conventionally-known mixing system of FIG. 7, in order to use the conventional remote control scheme. Namely, the individual head amplifiers 2 are assigned the serial ID numbers, with the leading ID number being assigned to any one of the head amplifiers, as if the plurality of head amplifiers 2 in the mixing system were daisy-chain connected to the mixer 1.

In the mixing system of FIG. 1, "format converter B", "format converter C" and "format converter D" are daisy-chain connected to "format converter A" that is in turn connected directly to the mixer 1, and four head amplifiers 2 are daisy-chain connected to each of the "format converter B", "format converter C" and "format converter D". Thus, the head amplifier 2 connected directly to "format converter B" located at an upstream position of the format converter network (i.e., immediately below "format converter A") is regarded as the nearest head amplifier to the mixer 1 and assigned ID number "#1". The three head amplifiers 2 daisy-chain connected to the head amplifier 2 of ID number "#1" are sequentially assigned ID numbers "#2", "#3" and "#4", respectively, in the order they are connected. Then, the four head amplifiers 2 daisy-chain connected to "format converter C", which is connected to "format converter B", are sequentially assigned ID numbers "#5", "#6", "#7" and "#8", respectively, in the order they are connected. Then, the four head amplifiers 2 daisy-chain connected to "format converter D", which is connected to "format converter C", are sequentially assigned ID numbers "#9", "#10", "#11" and "#12", respectively, in the order they are connected.

With the unique ID numbers assigned to the head amplifiers 2 in the aforementioned manner, the mixer 1 can remote-control settings of various channel-by-channel parameters of each of the head amplifiers 2, in accordance with a remote control method that is generally the same as or similar to the conventional remote control scheme (i.e., with control signals that are generally the same as or similar to the conventional control signals), as if the head amplifiers 2 themselves were connected to the mixer 1 as in the past. Detailed operational sequence for assigning the ID numbers to the head amplifiers 2 in the embodiment of the mixing system will be later described in greater detail with reference to FIG. 5.

Figure 4:
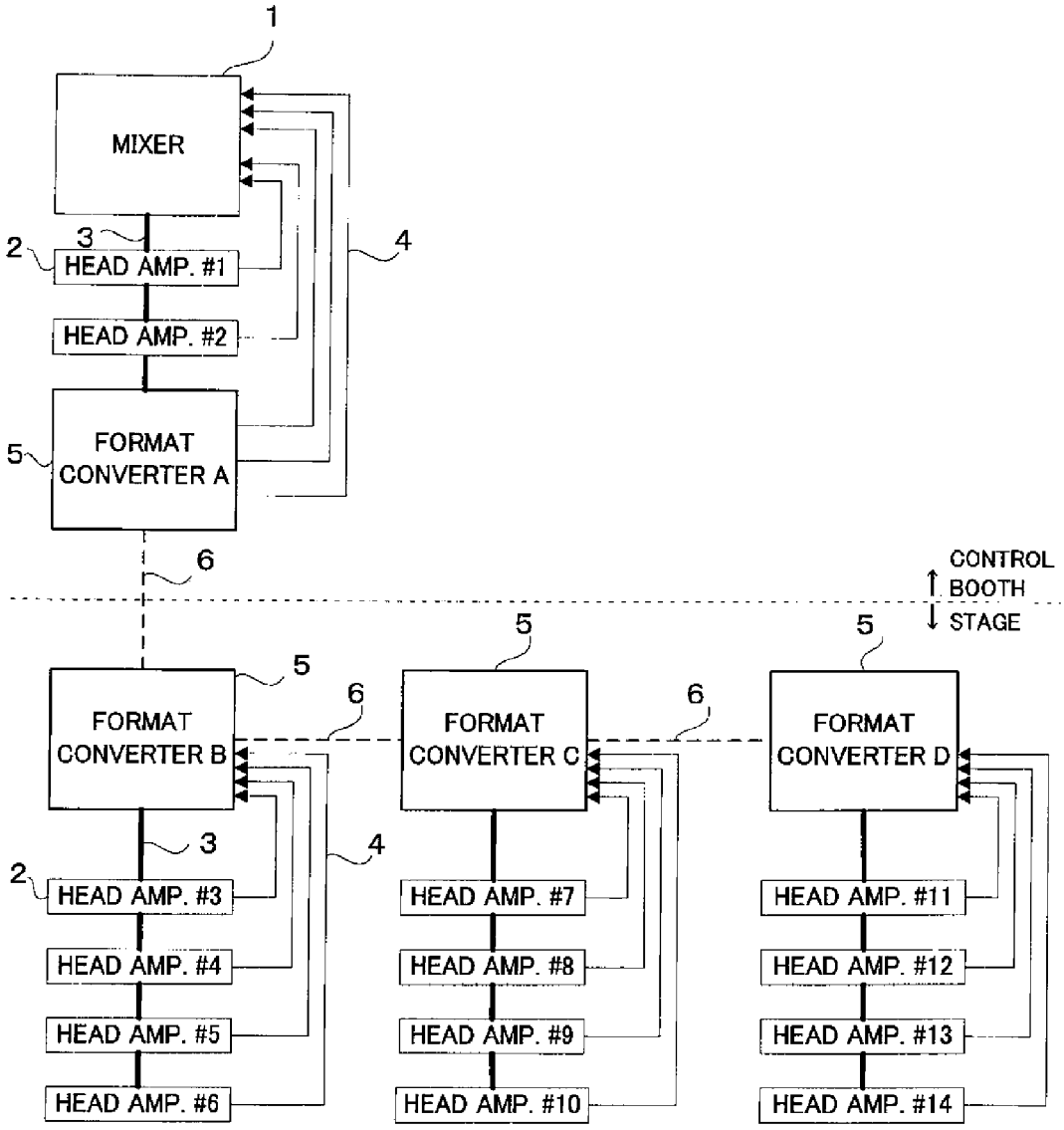
FIG. 4 is a block diagram showing another example of the general setup of the mixing system in accordance with an embodiment of the present invention.

FIG. 4 shows a mixing system in accordance with another embodiment of the present invention, which is different in construction from the mixing system of FIG. 1. In this mixing system, as shown in FIG. 4, two head amplifiers 2 are daisy-chain connected directly to the mixer 1. "format converter A" is connected with the second head amplifier 2, "format converter B", "format converter C" and "format converter D" are daisy-chain connected to "format converter A", and four head amplifiers 2 are daisy-chain connected to each of "format converter B", "format converter C" and "format converter D". In this case, the head amplifier 2 daisy-chain connected directly to the mixer 1 is assigned ID number "#1", the head amplifier 2 connected to the head amplifier 2 daisy-chain connected directly to the mixer 1 is assigned ID number "#2", and the head amplifier 2 daisy-chain connected directly to "format converter B" is assigned ID number "#3". Then, unique ID numbers are assigned to the other head amplifiers 2 on the basis of the same concept as explained above in relation to the system setup of FIG. 1. Thus, the four head amplifiers 2 daisy-chain connected to "format converter B" are assigned ID numbers "#3" to "#6", the four head amplifiers 2 daisy-chain connected to "format converter C" are assigned ID numbers "#7" to "#10", and the four head amplifiers 2 daisy-chain connected to "format converter D" are assigned ID numbers "#11" to "#14".

Figure 5:
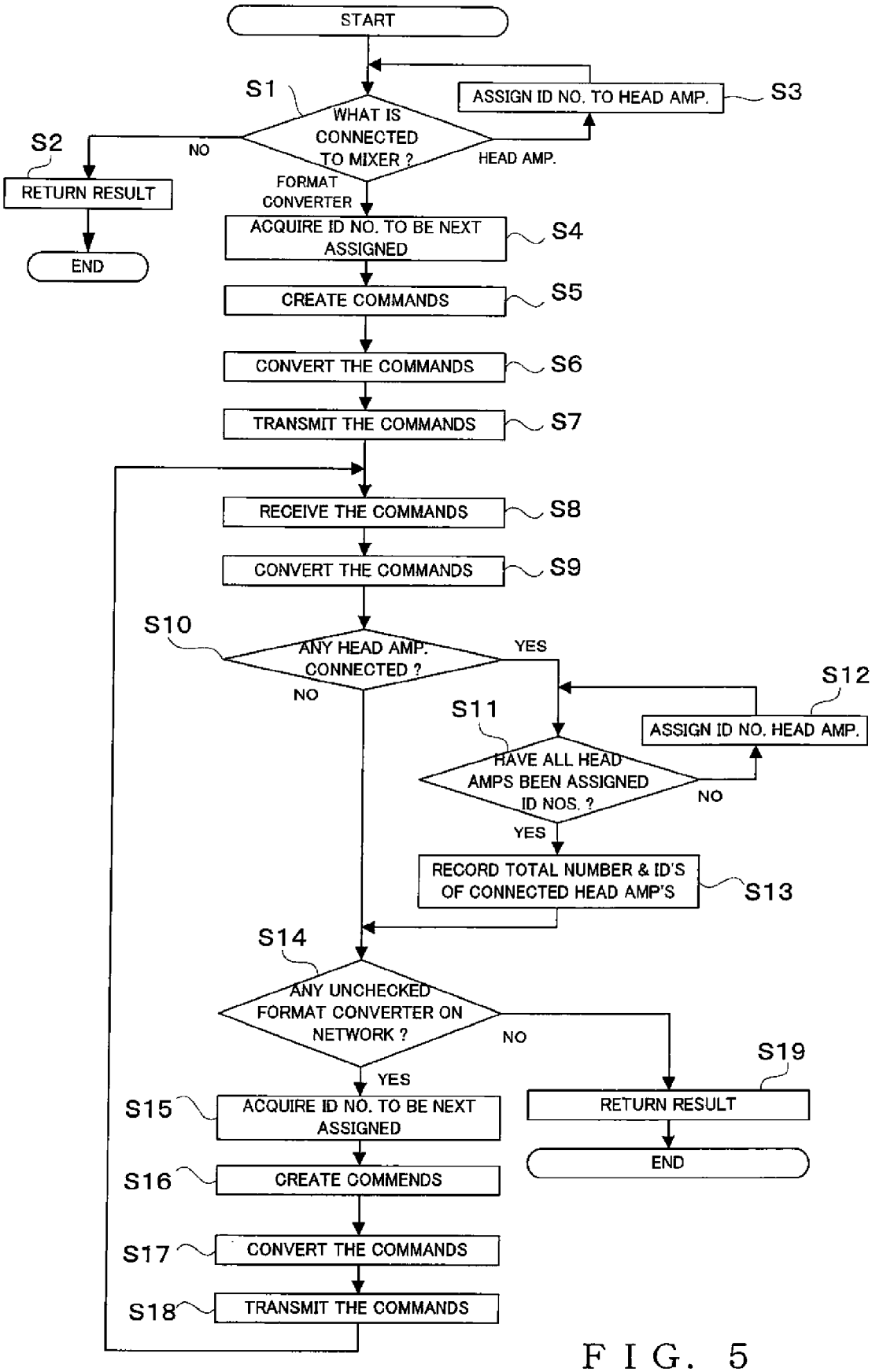
FIG. 5 is a flow chart showing an example operational sequence of a head amplifier search (i.e., ID number assignment) process performed in the embodiment of the mixing system.

FIG. 5 is a flow chart showing an example operational sequence of an ID number assignment process for assigning unique ID numbers to the head amplifiers 2. This ID number assignment process is intended to search the head amplifiers in the mixing system to assign an ID number to each external or peripheral device (head amplifier) which has not yet been assigned an ID number. The ID number assignment process is started up in response to the mixer 1 transmitting a "head-amplifier search command" to peripheral devices connected to the mixer 1. The head-amplifier search command is transmitted from the mixer 1 to the external or peripheral devices over the control lines 3. If there is no peripheral device connected to the mixer 1 ("NO" at step S1), the instant process is brought to an end after a search result "no peripheral device connected" is returned to the mixer 1 at step S2.

In the case where some head amplifier 2 is connected directly to the mixer 1 as in the system setup of FIG. 4 ("Head Amp" at step S1), an ID number is assigned, at step S3, to the head amplifier 2 connected directly to the mixer 1 in the same manner as in the conventional counterpart. If the plurality of head amplifiers 2 are daisy-chain connected to the mixer 1 as in the illustrated example of FIG. 4, the operation of step S3 is repeated to sequentially assign ID numbers to the plurality of head amplifiers 2 in the order they are daisy-chain connected to the mixer 1.

In the case where some format converter 5 is connected directly to the mixer 1 as in the system setup of FIG. 1, or in the case where the device immediately following the head amplifiers 2, daisy-chain connected to the mixer 1 and already assigned ID numbers, is a format converter 5 ("format converter" at step S1), the format converter 5 ("format converter A" in the illustrated example of FIG. 1 or 4) acquires an ID number to be next assigned (step S4). Then, a search command is created based on the acquired ID number, at step S5. Here, if some head amplifier 2 immediately precedes and is connected to an upstream end of the format converter 5, the "ID number to be next assigned" is an ID number following the ID number assigned to the immediately-preceding head amplifier 2. Further, if the format converter 5 is connected directly to the mixer 1, the "ID number to be next assigned" is "#1". Further, the command created at step S5 comprises a search command transmitted by the mixer 1, the above-mentioned "ID number to be next assigned", and a search completion notice related to the head amplifier 2 connected directly to the format converter 5 (in this case, "format converter A"). Because no head amplifier 2 is connected to "format converter A" in this case, "format converter A" does not have to conduct a head amplifier search. Thus, "format converter A" creates a new search command at steps S4 and S5 without conducting a head amplifier search for that format converter.

At step S6, "format converter A" converts the search command, created at step S5, into a format corresponding to the communication protocol (EtherSound protocol) for transmission of data over the control/audio line 6. Then, at step 7, "format converter A" transmits the search command to the following format converter 5 ("format converter B" in the illustrated example of FIG. 1 or 4) over the control/audio line 6.

Then, at step S8, "format converter B" receives the search command transmitted by "format converter A" at step S7, and then, at step S9, it not only converts the search command, received at step S8, into a format corresponding to the command communication protocol for data transmission over the control line 3 but also analyzes a message of the converted data (search command). After that, at step S10, "format converter B" starts head amplifier search/ID number assignment for each head amplifier 2 connected thereto, on the basis of the analyzed search command.

Namely, if any head amplifier 2 is currently connected to "format converter B" (YES determination at step S10), "format converter B" transmits the search command to each head amplifier 2, connected thereto, over the control line 3, and it assigns a unique ID number to each connected head amplifier 2, through operations of steps S11 and S12. More specifically, "format converter B" sequentially makes inquiries (head amplifier check) based on the search command, starting with the head amplifier 2 connected directly to "format converter B", so that unique ID numbers are sequentially assigned starting with the head amplifier 2 connected directly to "format converter B".

Upon completion of the assignment of ID numbers to all of the head amplifiers 2 connected to "format converter B" (YES determination at step S11), "format converter B" records the total number of the head amplifiers 2 connected thereto and the respective ID numbers assigned to the connected head amplifiers 2 (e.g., into a data table provided in the RAM 12). In this way, the format converter 5 can grasp the total number of the head amplifiers 2 connected thereto and the respective ID numbers assigned to the connected head amplifiers 2.

At step S14, "format converter B" makes a determination, on the basis of the IP addresses of the other format converters, as to whether any unchecked format converter 5 (i.e., format converter 5 that has not yet executed the ID assignment process on the head amplifiers) is on the network. If any unchecked format converter 5 is on the network (YES determination at step S14), "format converter B" acquires an ID number to be next assigned and creates a search command based on the acquired ID number at steps S15 and S16, in a similar manner to steps S4 and S5. Here, the "ID number to be next assigned" is an ID number following the ID number assigned to the last or rearmost one of the head amplifiers 2 daisy-chain connected to "format converter B". Then, "format converter B" converts the search command, created at step S15, into a format corresponding to the EtherSound protocol at step S17 and transmits the converted search command over the control/audio line 6 at step S18.

Then, all of the format converters 5 on the network perform the head amplifier search/ID number assignment through repetition of the operations at and after step S8. More specifically, the search command transmitted at step S18 above is received by "format converter C" connected to "format converter B", and, at steps S11-S13, "format converter C" sequentially assigns ID numbers to all of the head amplifiers 2, connected thereto, in the order the head amplifiers 2 are daisy-chain connected to "format converter C" and records the total number and respective ID numbers of the head amplifiers 2 connected thereto. Because the ID number assigned to the head amplifier 2 connected directly "format converter C" is an ID number following the ID number of the rearmost one of the head amplifiers 2 daisy-chain connected to "format converter B", it will never overlap with the ID numbers assigned to the head amplifiers 2 connected to "format converter B". Similarly, "format converter D" sequentially assigns serial ID numbers, following the ID number of the rearmost one of the head amplifiers 2 daisy-chain connected to "format converter C", to all of the head amplifiers 2 daisy-chain connected to "format converter D". Then, "format converter D" records the total number of the head amplifiers 2 connected thereto and the respective assigned ID numbers of the head amplifiers 2. In the aforementioned manner, serial ID numbers can be assigned to the plurality of head amplifiers 2 connected to the plurality of format converters 5 on the network.

If no head amplifier 2 is connected to the format converter 5 having received the search command at step S8 (NO determination at step S10), the process goes to step S14 in order to determine whether there is any unchecked format converter 5 on the network.

Upon completion of the head amplifier search/ID number assignment on all of the format converters 5 on the network (NO determination at step S14), the result of the search is returned to the mixer 1 at step S19, after which the process is brought to an end. In this way, the mixer 1 can grasp the total number of the head amplifiers 2 connected to the mixing system and respective ID numbers assigned to the connected head amplifiers 2. Whereas the mixer 1 recognizes the total number of the head amplifiers 2 connected to the mixing system and respective ID numbers of the connected head amplifiers 2, the configuration of the mixing system (e.g., where the format converters 5 are located, to which format converters 5 the individual head amplifiers 2 are connected, etc.) is no concern to the mixer 1. Namely, the mixer 1 recognizes the configuration of the mixing system as if the plurality of head amplifiers 2 were daisy-chain connected to the mixer 1 as in the conventionally-known mixing system. Thus, the mixer 1 can use as-is the conventional method for remote-controlling the head amplifiers 2.

Figure 6:
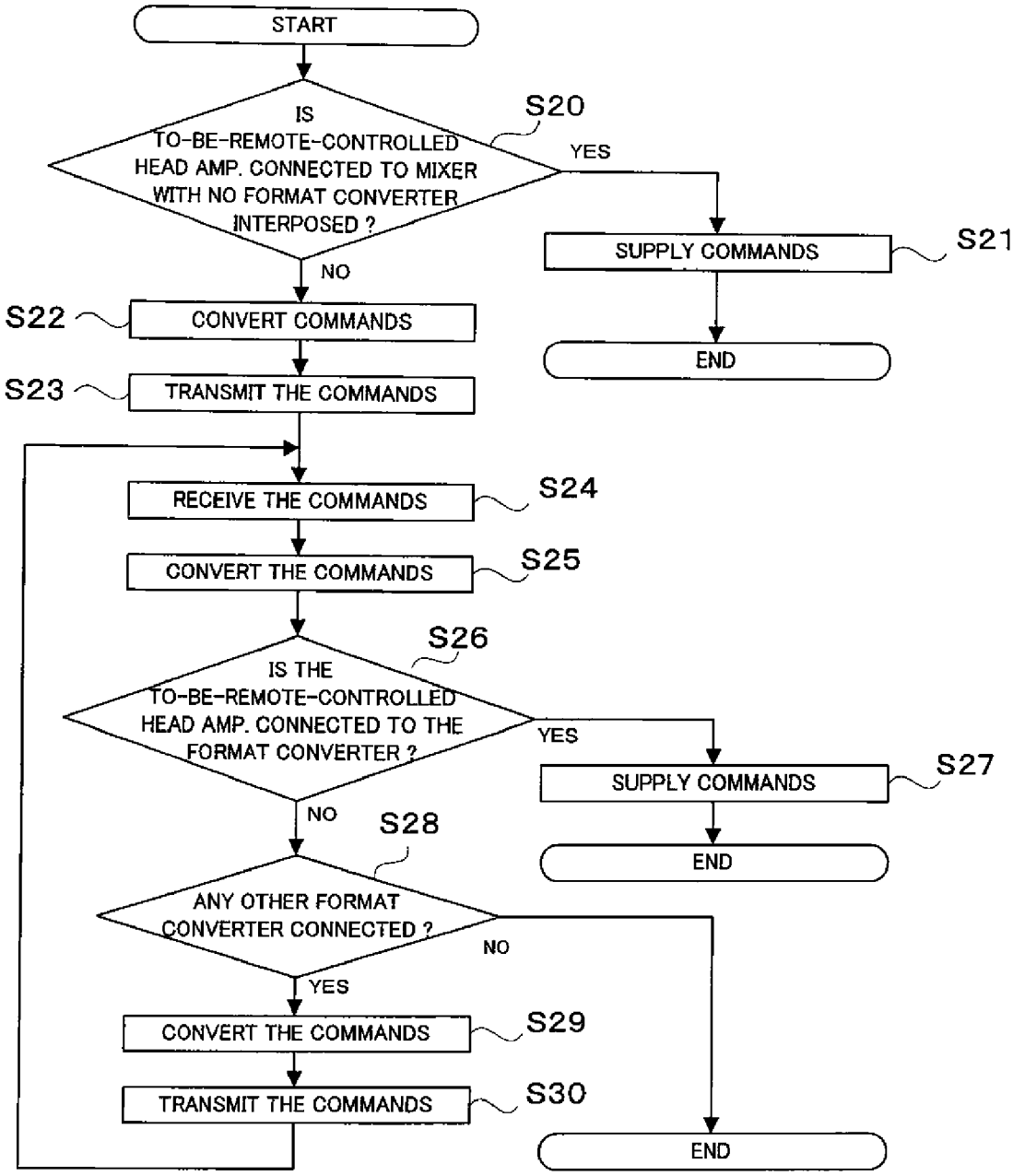
FIG. 6 is a flow chart showing an operational sequence of a process performed in the embodiment for transmitting control signals to a head amplifier for remote control of the head amplifier.

FIG. 6 is a flow chart showing an example operational sequence of a process for transmitting control signals to the head amplifiers 2 when the head amplifiers 2 are remote-controlled by the mixer 1. With reference to the flow chart of FIG. 6, a description will be given below about the control signal transmission from the mixer 1 to the head amplifiers 2. The mixer 1 can identify the individual head amplifiers 2 on the basis of the unique ID numbers, assigned to the head amplifiers 2 through the ID number assignment process of FIG. 5, and remote-control settings of various parameters per channel of each of the head amplifiers 2. The mixer 1 transmits, via the control line 3, control signals (commands), containing the ID number of any one of the head amplifiers 2 to be remote-controlled, to the peripheral device connected directly thereto. Because, as noted above, the plurality of head amplifiers 2 are sequentially assigned serial ID numbers with the leading ID number assigned to the head amplifier connected directly to the mixer 1, the mixer 1 only has to issue and address control signals to the ID number of the head amplifier 2 to be remote-controlled as in the conventionally-known system.

If the head amplifier 2 to be remote-controlled is connected to the mixer 1 with no format converter 5 interposed therebetween like the two head amplifiers 2 immediately below the mixer 1 of FIG. 4 (YES determination at step S20), the control signals (commands) transmitted from the mixer 1 over the control line 3 are supplied to the head amplifier 2 identified on the basis of the ID number contained in the control signals. Namely, the head amplifier 2 to be remote-controlled, which corresponds to the ID number, receives the control signals so that control (e.g., parameter setting) based on the received control signals is performed in the head amplifier 2 to be remote-controlled.

If the head amplifier 2 to be remote-controlled is connected to the mixer 1 with some format converter 5 interposed therebetween (NO determination at step S20), the control signals (commands) transmitted from the mixer 1 are supplied to "format converter A" located closest to the mixer 1. "format converter A" converts the control signals, transmitted from the mixer 1, into a format corresponding to the EtherSound protocol at step S22, and then it transmits the converted control signals to another format converter 5 following "format converter A" ("format converter B" in the illustrated example of FIG. 1 or 4) over the control/audio line 6 (step S23).

Then, at step S24, "format converter B" receives the control signals transmitted at step S23, and, at next step S25, it not only converts the received control signals into a format corresponding to the command communication protocol but also analyzes a message of the control signals. Because each of the format converters 5 has recorded therein the ID number of each of the head amplifiers 2 connected thereto as noted above (see step S13 of FIG. 5), "format converter B" having received the control signals can determine, by reference to the ID number contained in the control signals, whether or not the head amplifier 2 to be remote-controlled is connected to the format converter (i.e., "format converter B") (step S26).

If the head amplifier 2 to be remote-controlled is connected to the format converter ("format converter B") (YES determination at step S26), "format converter B" issues commands to the to-be-remote-controlled head amplifier 2 over the control line 3. Once the control signals are transmitted from "format converter B" to the group of head amplifiers 2 connected to the format converter, the control signals are sequentially forwarded from the head amplifier 2, connected directly to "format converter B", onward, so that one of the head amplifiers 2, corresponding to the ID number, receives the control signals.

If the head amplifier 2 to be remote-controlled is not connected to the format converter in question ("format converter B") (NO determination at step S26), "format converter B" determines, on the basis of the IP addresses of the format converters on the network, whether there is any other format converter resident on (i.e., connected to) the network (step S28). If there is any other format converter (except "format converter A") connected to the network (YES determination at step S28), "format converter B" converts the control signals, transmitted from the mixer 1, into a format corresponding to the EtherSound protocol at step S29, and then, at step S30, it transmits the converted control signals to the other format converter 5 following "format converter B" ("format converter C" in the illustrated example of FIG. 1 or 4). If there is no other format converter (except "format converter A") connected to the network (NO determination at step S28), it means that the head amplifier 2 to be remote-controlled does not exist in the mixing system, and thus, the control signals are discarded, after which the process is brought to an end.

If the head amplifier 2 to be remote-controlled is connected to the other format converter on the network as determined through the operations at and after step S24 above, the other format converter supplies the received control signals to the head amplifier 2 to be remote-controlled. If, on the other hand, the head amplifier 2 to be remote-controlled is not connected to the other format converter, the other format converter forwards the received control signals to a following format converter 5 if any.

Thus, in the above-described embodiment of the mixing system, various channel-by-channel parameter settings of each of the head amplifiers 2 connected to the mixer 1 by way of one or more format converters 5 can be remote-controlled by the mixer 1 in the same manner as in the conventionally-known mixing system (as viewed from the mixer 1). Note that, when control signals are to be transmitted from any one of the head amplifiers 2 to the mixer 1, these control signals are merely transmitted via one or more format converters 5 and thus the transmission of the control signals does not particularly differ from the conventional transmission scheme as viewed from the head amplifier 2.

According to the present invention, as set forth above, the format converter 5, constructed to convert control and digital audio signals into a format that allows the control and digital audio signals to be transmitted over a single physical cable (i.e., control/audio line) 6, is provided between the mixer 1 and a group of the head amplifiers 2. Thus, the present invention can advantageously simplify the necessary wiring between the mixer 1 and the group of the head amplifiers 2 which used be very complicated wring composed of a control line and a multiplicity of audio lines. Particularly, in a relatively large concert venue or the like, where the mixer 1 and a group of the head amplifiers 2 are physically distant from each other, long wiring between the mixer 1 and the group of the head amplifiers 2 can be implemented by only one physical cable (control/audio line) 6, and thus, the present invention can significantly simplify the necessary wiring. Further, because a relatively-inexpensive general-purpose LAN cable can be used as the control/audio line 6, the present invention can also significantly reduce the necessary wiring cost. Furthermore, because the conventionally-known scheme or method can be used as-is for remote-controlling any of the head amplifiers 2 by the mixer 1, the present invention allows the mixer 1 and head amplifiers 2 of the conventional constructions to be incorporated into the mixing system, provided with the format converters 5, without requiring any change to the conventional constructions and specifications of the mixer 1 and head amplifiers 2.

Note that the mixing system shown in FIG. 1 or FIG. 4 is just an illustrative example, and the number of the format converters 5 and the number of the head amplifiers 2 connected to each of the format converters 5 in the present invention are not limited to the aforementioned. Furthermore, whereas the head amplifiers 2 have been described above as examples of the peripheral or external devices involved in audio signal processing, the basis principles of the present invention are also applicable to digital audio devices than the head amplifiers. Furthermore, the flow charts of FIGS. 5 and 6 showing processes for assigning unique ID numbers to the individual head amplifiers 2 and for remote controlling the head amplifiers 2 are just intended to explain how the ID number assignment and remote control per head amplifier is performed in the present invention using the conventional methods. Namely, the unique ID number assignment and remote control per head amplifier may be performed in the present invention using any other suitable methods than those of FIGS. 5 and 6 as long as the methods used are similar to the conventional methods.

Furthermore, whereas the preferred embodiment has been described above in relation to the case where the format converters 5 are interconnected in a daisy-chain configuration, the present invention is not so limited, and the format converters 5 may be interconnected in a star configuration with a single central hub device. In such a case, although the format converters 5 are interconnected in a star configuration, the mixer 1 recognizes as if the head amplifiers 2 were daisy-chain connected to the mixer 1, and thus, the remote control per head amplifier 2 can be performed using as-is generally the same method as the conventional counterpart.

Furthermore, whereas the preferred embodiment has been described above in relation to the case where the EtherSound protocol is applied as an example of the communication protocol for communicating data over the control/audio lines 6, the present invention is not so limited, and any other suitable communication protocols, such as the CobraNet® communication protocol, may be applied as along as audio and control signals can be transmitted over a single physical cable.

This application is based on, and claims priority to, Japanese Patent Application No. 2006-268441 filed on Sep. 29, 2006. The disclosure of the priority application, in its entirety, including the drawings, claims, and the specification thereof, is incorporated herein by reference.

What is claimed is:

1. A format conversion device for use in a mixing system that includes an audio mixer and at least one peripheral device involved in audio signal processing, and at least two of the format conversion devices, a first-type physical cable functioning as a control data communication line for communicating control data using a predetermined control data communication format and a second-type physical cable functioning as an audio data communication line for communicating audio data using a predetermined audio data communication format being connectable to each of the audio mixer and the peripheral device, each of said format conversion devices comprising:

a first-type interface for connection with the first-type physical cable, said first-type interface connecting, via the control data communication line, with at least one of the audio mixer and the at least one peripheral device;

a second-type interface for connection with the second-type physical cable, said second-type interface connecting, via the audio data communication line, with said at least one of the audio mixer and the at least one peripheral device, wherein both the control data communication line and the audio data communication line are connected to said at least one of the audio mixer and the at least one peripheral device;

a third-type interface for connection with a third-type physical cable functioning as a control/audio line communication, said control/audio communication line functioning to communicate data using a control/audio communication format that allows control data and audio data to be transmitted over a common cable, said third-type interface connecting with other of the format conversion devices; and a control section connected to each of said first-type, second-type and third-type interfaces, said control section acting as a bridge for data delivery between said first- and second-type interfaces and said third-type interface and also converting a communication format of data, to be delivered from a transmitting-side interface to a receiving-side interface, from a communication format of the transmitting-side interface to a communication format of the receiving-side interface, wherein said control section converts the control data and the audio data received from the audio mixer or the peripheral device, connected thereto via the control data communication line and the audio data communication line, to data of the control/audio communication format and transmits the converted data of the control/audio communication format to the other format conversion device connected thereto via the control/audio communication line, and said control section converts data of the control/audio communication format, received from the other format conversion device, to control data of the control data communication format and audio data of the audio data communication format and transmits the converted control data and audio data to the audio mixer or the peripheral device connected thereto via the control data communication line or the audio data communication line.

2. A format conversion device as claimed in claim 1 wherein, 1) when data is to be delivered from said first-type interface to said third-type interface, said control section converts control data of the control data communication format into control data of the control/audio communication format, 2) when data is to be delivered from said second-type interface to said third-type interface, said control section converts audio data of the audio data communication format into audio data of the control/audio communication format, 3) when data is to be delivered from said third-type interface to said first-type interface, said control section converts control data of the control/audio communication format into control data of the control data communication format, and 4) when data is to be delivered from said third-type interface to said second-type interface, said control section converts audio data of the control/audio communication format into audio data of the audio data communication format.

3. A format conversion device as claimed in claim 1 wherein said first-type interface is a serial communication interface, said second-type interface is a digital audio communication interface, and said third-type interface is a LAN interface.

4. A format conversion device as claimed in claim 1 which includes at least one said first-type interface, a plurality of the second-type interfaces and one said third-type interface, and wherein said audio mixer and said at least one peripheral device, or a plurality of the peripheral devices are connectable to said format conversion device via the plurality of the second-type interfaces.

5. A format conversion device as claimed in claim 4 wherein each of the plurality of the peripheral devices is connected, via said second-type physical cable, to a respective one of the plurality of the second-type interfaces, one of the plurality of the peripheral devices is connected, via said first-type physical cable, to said first-type interface, and the plurality of the peripheral devices are interconnected in a daisy-chain configuration via said first-type physical cable functioning as a control data communication line.

6. A mixing system including at least first and second format conversion devices each constructed as recited in claim 1 wherein the first format conversion device has the first- and second-type interfaces thereof connected to the audio mixer via the first- and second-type physical cables, respectively, the second format conversion device has the first- and second-type interfaces thereof connected to at least one peripheral device via said first- and second-type physical cables, respectively, and the third-type interface of said first format conversion device and the third-type interface of said second format conversion device are connected with each other.

7. A mixing system as claimed in claim 6 wherein a plurality of the peripheral devices are daisy-chain connected to the second format conversion device via the first-type physical cable functioning as a control data communication line.

8. A mixing system as claimed in claim 6 which further includes a third format conversion device or third and further format conversion devices, said third format conversion device is connected to the second format conversion device via said third-type interface, and said third format conversion device or third and further format conversion devices each has the first- and second-type interfaces thereof connected to at least one said peripheral device via said first- and second-type physical cables.

9. A mixing system as claimed in claim 8 wherein said third format conversion device, and a fourth format conversion device or fourth and further format conversion devices are daisy-chain connected via respective said third-type interfaces thereof.

10. A mixing system including at least first and second format conversion devices each constructed as recited in claim 1 wherein at least one said peripheral device and the audio mixer are daisy-chain connected, via the first-type physical cable functioning as a control data communication line, to the first-type interface of the first format conversion device, the second-type interface of the first format conversion device is connected to the audio mixer via the second-type physical cable, the second format conversion device has the first- and second-type interfaces thereof connected to at least one other said peripheral device via the first- and second-type physical cables, respectively, and the third-type interface of said first format conversion device and the third-type interface of said second format conversion device are connected with each other.

11. A mixing system as claimed in claim 10 wherein a plurality of the peripheral devices are daisy-chain connected to the second format conversion device via the first-type physical cable functioning as a control data communication line.

12. A mixing system as claimed in claim 10 which further includes a third format conversion device or third and further format conversion devices, said third format conversion device is connected to the second format conversion device via said third-type interface, and said third format conversion device or third and further format conversion devices each has the first- and second-type interfaces thereof connected to at least one said peripheral device via said first- and second-type physical cables.

13. A mixing system as claimed in claim 12 wherein said third format conversion device, and a fourth format conversion device or fourth and further format conversion devices are daisy-chain connected via respective said third-type interfaces thereof.

14. A format conversion method for use in a mixing system that includes an audio mixer and at least one peripheral device involved in audio signal processing, and at least two format conversion devices, a first-type physical cable functioning as a control data communication line for communicating control data using a predetermined control data communication format and a second-type physical cable functioning as an audio data communication line for communicating audio data using a predetermined audio data communication format being connectable to each of the audio mixer and the peripheral device, said format conversion method for each of said format conversion devices comprising:

a step of providing a first-type interface for connection with the first-type physical cable which is connected, via the control data communication line, to one of the audio mixer and the at least one peripheral device;

a step of providing a second-type interface for connection with the second-type physical cable which is connected, via the audio data communication line, to said one of the audio mixer and the at least one peripheral device, wherein both the control data communication line and the audio data communication line are connected to said at least one of the audio mixer and the at least one peripheral device;

a step of providing a third-type interface for connection with a third-type physical cable functioning as a control/audio communication line, said control/audio communication line functioning to communicate data using a control/audio communication format that allows control data and audio data to be transmitted over a common cable, said third-type interface connecting with other of the format conversion devices; and a step of providing a control section connected to each of said first-type, second-type and third-type interfaces, said control section acting as a bridge for data delivery between said first- and second-type interfaces and said third-type interface and also converting a communication format of data, to be delivered from a transmitting-side interface to a receiving-side interface, from a communication format of the transmitting-side interface to a communication format of the receiving-side interface, wherein said control section converts the control data and the audio data received from the audio mixer or the peripheral device, connected thereto via the control data communication line and the audio data communication line, to data of the control/audio communication format and transmits the converted data of the control/audio communication format to the other format conversion device connected thereto via the control/audio communication line, and said control section converts data of the control/audio communication format, received from the other format conversion device, to control data of the control data communication format and audio data of the audio data communication format and transmits the converted control data and audio data to the audio mixer or the peripheral device connected thereto via the control data communication line or the audio data communication line.

* * * * *